US005379855A

United States Patent [19]

Juang

[11] Patent Number: 5,379,855

[45] Date of Patent: Jan. 10, 1995

[54] ELEVATING MECHANISM

[76] Inventor: Jenn-Ming Juang, P.O. Box 1750, Taichung, Taiwan, Prov. of China

[21] Appl. No.: 181,210

[22] Filed: Jan. 13, 1994

[51] Int. Cl.[6] ..... B66B 11/04

[52] U.S. Cl. ..... 187/269; 254/122

[58] Field of Search ..... 187/18, 9 R, 8.71, 8.72, 187/24, 25; 254/122; 182/141

[56] References Cited

U.S. PATENT DOCUMENTS 2,445,004 7/1948 Reynolds et al. ..... 187/18

3,623,707 11/1971 Klopp ..... 187/18

4,405,116 9/1983 Eisenberg ..... 187/18

*Primary Examiner*—Kenneth W. Noland

[57] ABSTRACT

An elevating mechanism includes a frame supported above and in parallel to a base, the base and the frame are stably coupled together by a pair of lazy tong constructions, the pair of lazy tong constructions include four pivot axles defining a plane which is parallel to the base and the frame, a block secured on each of the pivot axles for engaging with two parallel bolts, the end portions of the bolts have outer thread of different screw directions such that the blocks are caused to move toward each other or to move away from each other when the bolts are rotated, the lazy tong constructions can thus be extended or retracted when the blocks are moved toward each other or moved away from each other.

2 Claims, 4 Drawing Sheets

ELEVATING MECHANISM

BACKGROUND OF THE INVENTION

1. Field of the Invention

The present invention relates to an elevating mechanism, and more particularly to an elevating mechanism having a stable configuration.

2. Description of the Prior Art

A typical elevating mechanism is shown in FIG. 5 and comprises a base 11 and a board 10 supported in parallel above the base by a lazy tong construction 12 which includes a number of beams secured together by screws 13, at least one groove 14 formed in each of the base 11 and the board 10 for slidingly receiving the pin elements of the lazy tong construction 12, and a motor 15 for actuating the lazy tong construction so as to move the board 10 up and down; however, such an elevating mechanism has an unstable configuration and is apt to swing.

The present invention has arisen to mitigate and/or obviate the afore-described disadvantages the conventional elevating mechanisms.

SUMMARY OF THE INVENTION

The primary objective of the present invention is to provide an elevating mechanism which has a stable configuration.

In accordance with one aspect of the invention, there is provided an elevating mechanism comprising a base, a frame disposed in parallel to the base and located above the base, a pair of lazy tong constructions coupled between the base and the frame and including two pairs of pivot axles defining an actuating plane in parallel to the base and the frame, four blocks secured on the pivot axles respectively and each including an inner thread formed therein, a bolt including two end portions having outer thread of different directions for threadedly engaging with the inner threads of the two pairs of blocks such that the pairs of blocks are caused to move toward each other or to move away from each other when the bolt is rotated, the lazy tong constructions being extended or retracted when the pairs of blocks are moved toward each other or moved away from each other, and means for rotating the bolts so as to move the pairs of blocks toward each other or to move the pairs of blocks away from each other, whereby, the frame is caused to move up and down relative to the base.

Each of the bolts includes a middle portion having a smooth outer surface, the rotating means includes two pairs of sleeves rotatably engaged on the middle portions of the bolts, two first sprockets secured on the middle portions of the bolts respectively, a pair of plates fixed to the sleeves and arranged in perpendicular to the bolts, a motor fixed to one of the plates and including a spindle having two second sprockets secured thereon, two chains coupling the first, sprockets and the second sprockets together, whereby, the bolts are rotated by the motor via the sprockets and chains.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
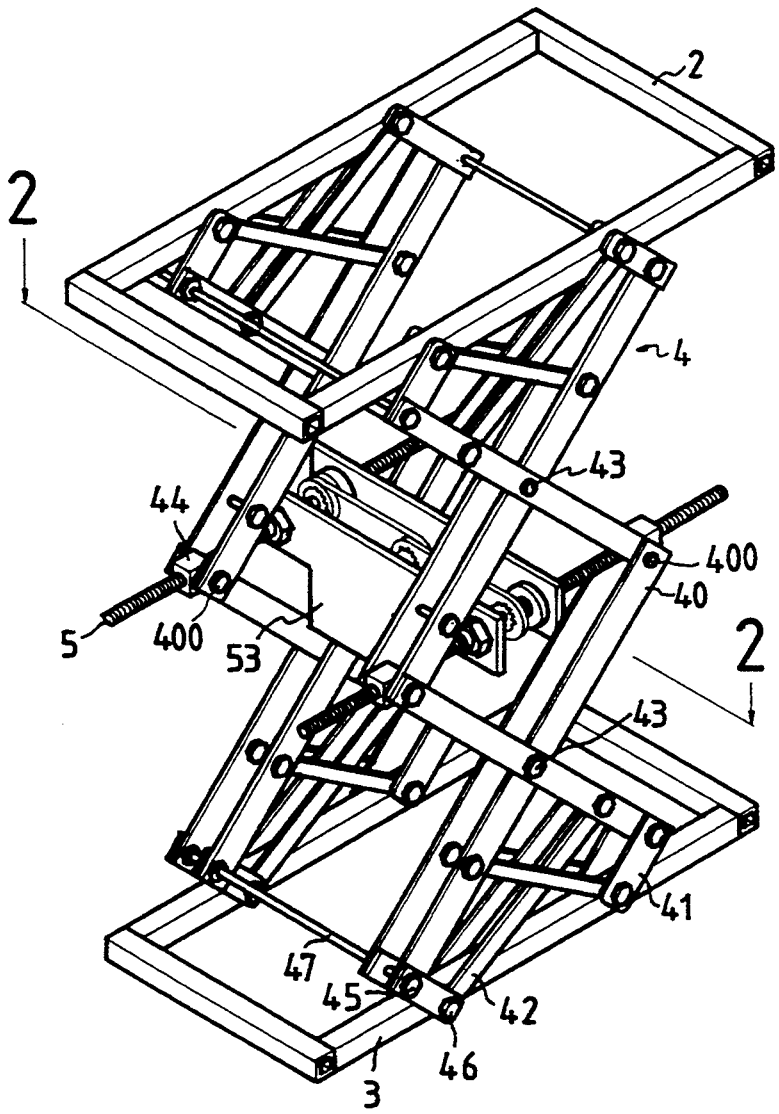
FIG. 1 is a perspective view of an elevating mechanism in accordance with the present invention.
Figure 2:
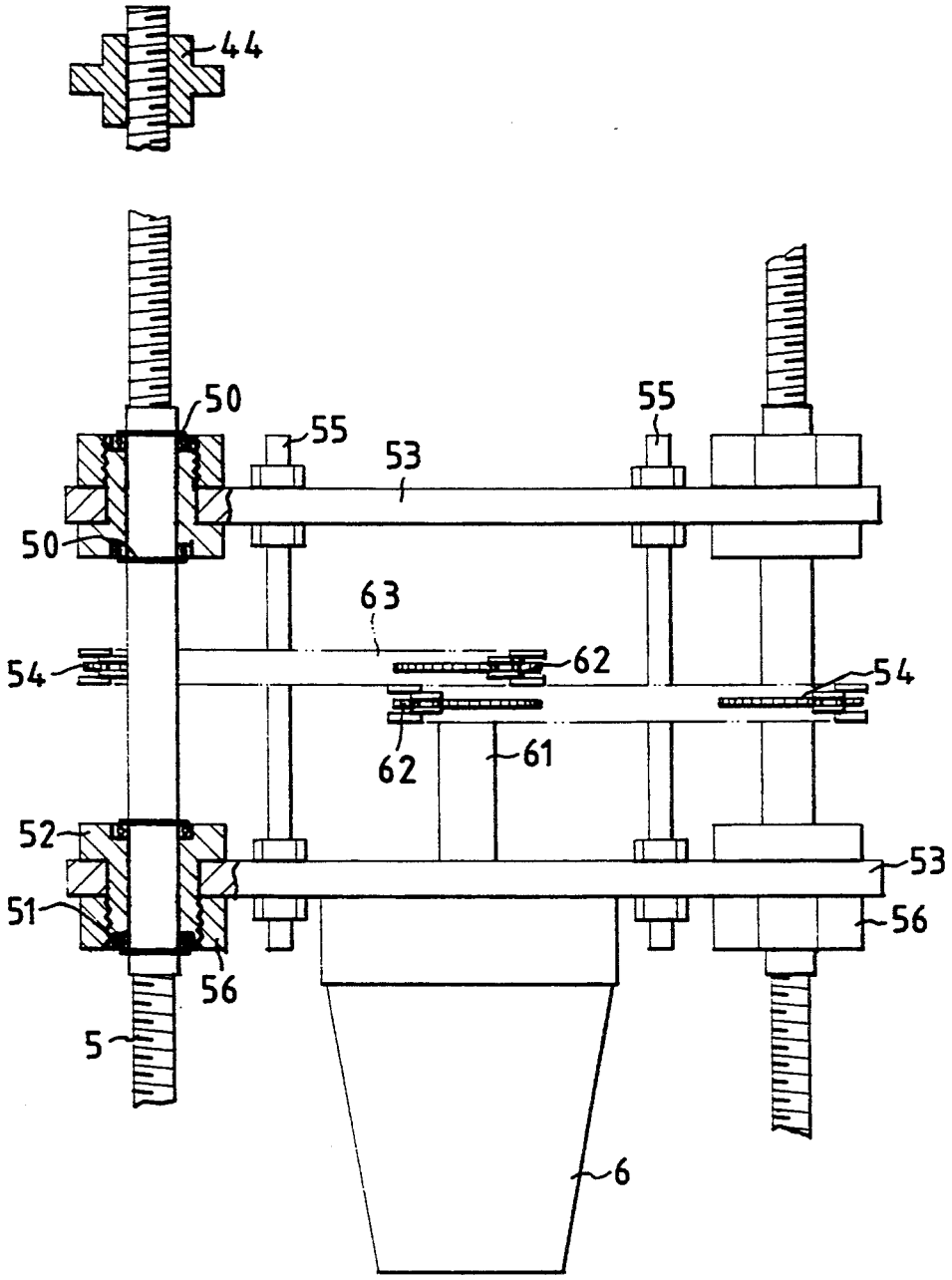
FIG. 2 is a cross sectional view taken along lines 2—2 of FIG. 1.
Figure 3:
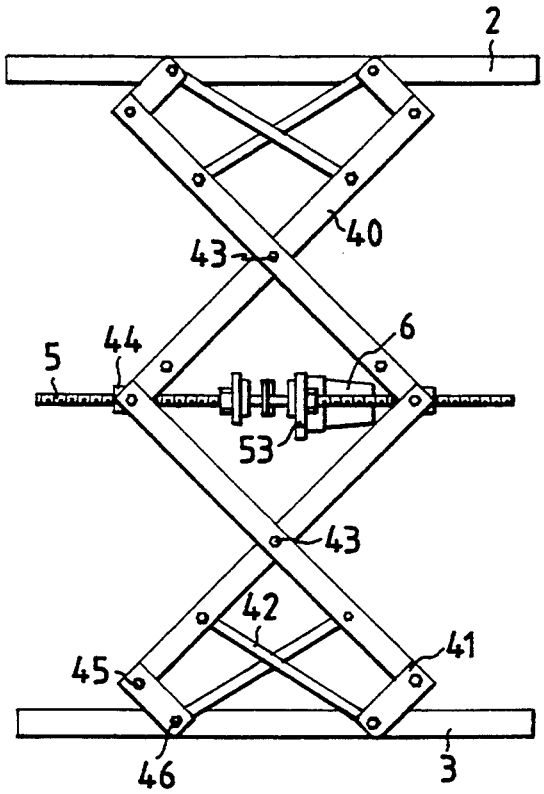
FIGS. 3 and 4 are plane views illustrating the operations of the elevating mechanism.

Referring to FIGS. 1, 2 and 3, an elevating mechanism in accordance with the present invention comprises a base 3 and a frame 2 supported in parallel above the base 3 by a pair of lazy tong construction 4, each of the lazy tong constructions 4 includes four beams 40 pivotally coupled together so as to form two pairs of crossed beams which are pivotally coupled together at four pivot axles 400, each pair of crossed beams includes a pivot axle 43 formed in the center portion thereof, two pairs of levers 41 pivotally coupled between the lazy tong construction 4 and the base 3 and the frame 2 respectively at two pivot axles 45, 46, and two pairs of links 42 further provided and coupled between the the lazy tong construction 4 and the base 3 and the frame 2 respectively such that frame 2 can be stably supported in parallel to the base 3. A number of rods 47 are further provided to be coupled between the pair of lazy tong constructions so as to stably couple the pair of lazy tong constructions together.

The four pivot axles 400 define an actuating plane in parallel to the base and the frame, and each of the pivot axles 400 includes a block 44 provided therein, each of the blocks 44 includes an inner thread formed therein, two parallel bolts 5 each includes two end portions threadedly engaged with the bolcks 44 respectively, the outer threads formed on the two end portions of each of the bolts 5 have different screw direction such that the blocks 44 can be caused to move toward each other or to move away from each other when the bolt 5 is rotated, the middle portion of each of the bolts 5 includes no thread formed thereon and includes two sleeves 52 rotatably supported thereon by bearings 51, C-clamps 50 are fixed on the middle portions of the bolts 5 and engaged with the sleeves 52 so as to limit the sleeves 52 to rotational movement only, two plates 53 are fixed to the sleeves 52 by nuts 56 and are further fixed together by bolts 55 such that the plates 53 are solidly coupled together and will not move relative to each other, the plates 53 are arranged perpendicular to the bolts 5. Two sprockets 54 are fixed on the middle portions of the blots 5 respectively, a motor 6 is fixed to one of the plates 53 and includes a spindle 61 extended to a position located between the plates 53, two sprockets 62 are fixed on the spindle 61 and coupled to the sprockets 54 by two chains 63 respectively such that the bolts 5 can be rotated by the motor 6.

Figure 4:
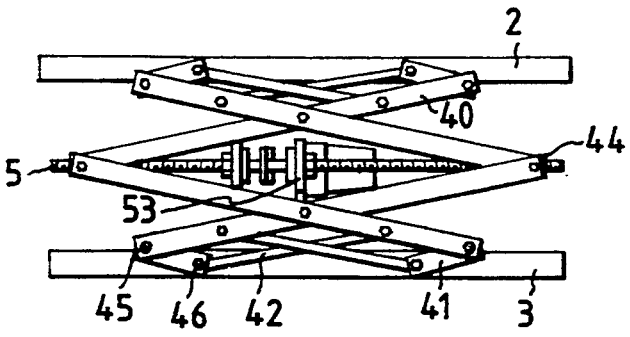
Figure 5:
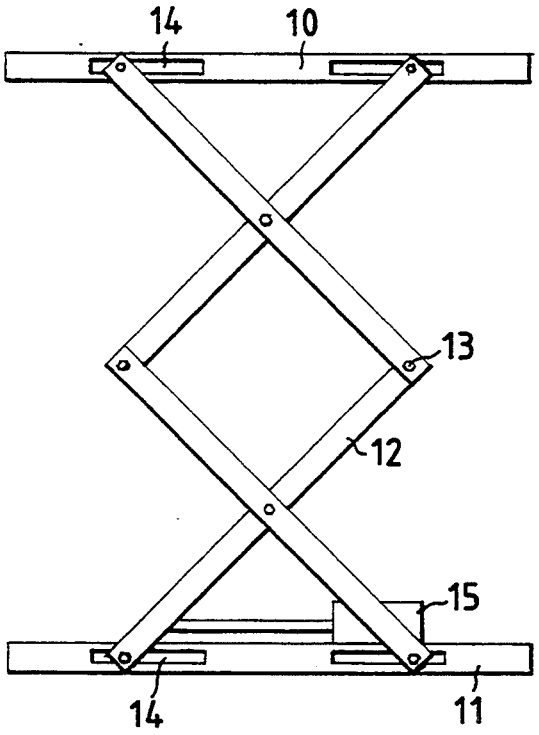
FIG. 5 is a plane view illustrating a typical elevating mechanism.

As shown in FIGS. 3 and 4, the rotational directions of the spindle 61 can be changed such that the two pairs of blocks 44 can be caused to move toward each other or to move away from each other when the bolt 5 is rotated by the motor 6, the lazy tong constructions are thus being extended or retracted when said pairs of blocks are moved toward each other or moved away from each other, such that the frame 2 can be caused to move up and down relative to the base 3.

Accordingly, the elevating mechanism in accordance with the present invention includes a stable configuration, the base and the frame are stably coupled together by the lazy tong constructions such that the elevating mechanism will not swing when elevated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An elevating mechanism comprising a base, a frame disposed in parallel to said base and located above said base, a pair of lazy tong constructions coupled between said base and said frame and including two pairs of pivot axles defining an actuating plane in parallel to said base and said frame, four blocks secured on said pivot axles respectively and each including an inner thread formed therein, a bolt including two end portions having outer thread of different directions for threadedly engaging with said inner threads of said two pairs of blocks such that said pairs of blocks are caused to move toward each other or to move away from each other when said bolt is rotated, said lazy tong constructions being extended or retracted when said pairs of blocks are moved toward each other or moved away from each other, and means for rotating said bolts so as to move said pairs of blocks toward each other or to move said pairs of blocks away from each other, whereby, said fame is caused to move up and down relative to said base.

2. An elevating mechanism according to claim 1, wherein each of said bolts includes a middle portion having a smooth outer surface, said rotating means includes two pairs of sleeves rotatably engaged on said middle portions of said bolts, two first sprockets secured on said middle portions of said bolts respectively, a pair of plates fixed to said sleeves and arranged in perpendicular to said bolts, a motor fixed to one of said plates and including a spindle having two second sprockets secured thereon, two chains coupling said first sprockets and said second sprockets together, whereby, said bolts are rotated by said motor via said sprockets and chains.

* * * * *